US011882876B2

(12) United States Patent
Lee et al.

(10) Patent No.: US 11,882,876 B2
(45) Date of Patent: Jan. 30, 2024

(54) CARTRIDGE AND AEROSOL GENERATING DEVICE INCLUDING THE SAME

(71) Applicant: KT&G CORPORATION, Daejeon (KR)

(72) Inventors: Jong Sub Lee, Seongnam-si (KR); Won Kyeong Lee, Guri-si (KR); Dae Nam Han, Daejeon (KR); Jin Soo Seong, Seoul (KR); Sung Wook Yoon, Suwon-si (KR); Jae Min Lee, Siheung-si (KR)

(73) Assignee: KT&G CORPORATION, Daejeon (KR)

( * ) Notice: Subject to any disclaimer, the term of this patent is extended or adjusted under 35 U.S.C. 154(b) by 828 days.

(21) Appl. No.: 16/975,620

(22) PCT Filed: May 7, 2020

(86) PCT No.: PCT/KR2020/006030
§ 371 (c)(1),
(2) Date: Aug. 25, 2020

(87) PCT Pub. No.: WO2021/015402
PCT Pub. Date: Jan. 28, 2021

(65) Prior Publication Data

US 2021/0022396 A1 Jan. 28, 2021

(30) Foreign Application Priority Data

Jul. 23, 2019 (KR) ..... 10-2019-0089202

(51) Int. Cl.
*A24F 40/42* (2020.01)
*A24F 40/46* (2020.01)
(Continued)

(52) U.S. Cl.
CPC ..... *A24F 40/42* (2020.01); *A24F 40/46* (2020.01); *A24F 40/53* (2020.01); *A24F 40/10* (2020.01); *A24F 40/60* (2020.01)

(58) Field of Classification Search
CPC ..... A24F 40/42; A24F 40/53; A24F 40/46
See application file for complete search history.

(56) References Cited

U.S. PATENT DOCUMENTS 9,918,495 B2 3/2018 DePiano et al.
10,154,691 B2 12/2018 Feldman et al.
(Continued)

FOREIGN PATENT DOCUMENTS

CN 202407082 U 9/2012
CN 202456410 U 10/2012
(Continued)

OTHER PUBLICATIONS

International Search Report dated Feb. 22, 2021 from the International Searching Authority in International Application No. PCT/KR2020/006030.
(Continued)

*Primary Examiner* — Phuong Chi Thi Nguyen
(74) *Attorney, Agent, or Firm* — Sughrue Mion, PLLC

(57) ABSTRACT

A cartridge includes a storage configured to store an aerosol generating material; a heater configured to heat the aerosol generating material to generate aerosol; and at least one terminal configured to transfer power from an external battery to the heater and comprising a conductive structure surrounding a wire connected to the heater, wherein the conductive structure takes a compressed form in which the wire is in contact with the conductive structure.

11 Claims, 6 Drawing Sheets

(51) Int. Cl.

| | |
|---|---|
| ***A24F 40/53*** | (2020.01) |
| *A24F 40/60* | (2020.01) |
| *A24F 40/10* | (2020.01) |

(56) References Cited

U.S. PATENT DOCUMENTS

| | | | | |
|---|---|---|---|---|
| 2015/0245659 | A1 | 9/2015 | DePiano et al. | |
| 2016/0143365 | A1 | 5/2016 | Liu | |
| 2016/0374391 | A1 | 12/2016 | Liu | |
| 2017/0105454 | A1 | 4/2017 | Ll et al. | |
| 2020/0046028 | A1 | 2/2020 | Oh et al. | |
| 2022/0110371 | A1 | 4/2022 | DePiano et al. | |
| 2022/0354169 | A1* | 11/2022 | Cho | A24F 40/40 |
| 2022/0361583 | A1* | 11/2022 | Lee | A24F 40/10 |
| 2023/0134145 | A1* | 5/2023 | Park | G01B 7/30 131/329 |
| 2023/0284704 | A1* | 9/2023 | Wang | A24F 40/42 131/329 |

FOREIGN PATENT DOCUMENTS

| | | | |
|---|---|---|---|
| CN | 203424294 | U | 2/2014 |
| CN | 106231932 | A | 12/2016 |
| EP | 2779786 | A1 | 9/2014 |
| JP | 3164992 | U | 12/2010 |
| JP | 2016-509361 | A | 3/2016 |
| JP | 2017-508458 | A | 3/2017 |
| JP | 2018-92757 | A | 6/2018 |
| KR | 20-0460784 | Y1 | 6/2012 |
| KR | 10-1523088 | B1 | 5/2015 |
| KR | 10-2016-0048022 | A | 5/2016 |
| KR | 10-2018-0117039 | A | 10/2018 |
| WO | 2013149484 | A1 | 10/2013 |
| WO | 2014/139610 | A1 | 9/2014 |
| WO | 2018/234585 | A1 | 12/2018 |

OTHER PUBLICATIONS

Communication dated Feb. 5, 2021 from the Korean Intellectual Property Office in KR application No. 10-2019-0089202.

Office Action dated Mar. 23, 2023 in Chinese Application No. 202080001934.0.

Extended European Search Report dated Sep. 24, 2021 in European Application No. 20758094.5.

Notice of Reasons for Refusal dated Nov. 9, 2021 from the Japanese Patent Office in Japanese Application No. 2020-549760.

* cited by examiner

【Figure 1】
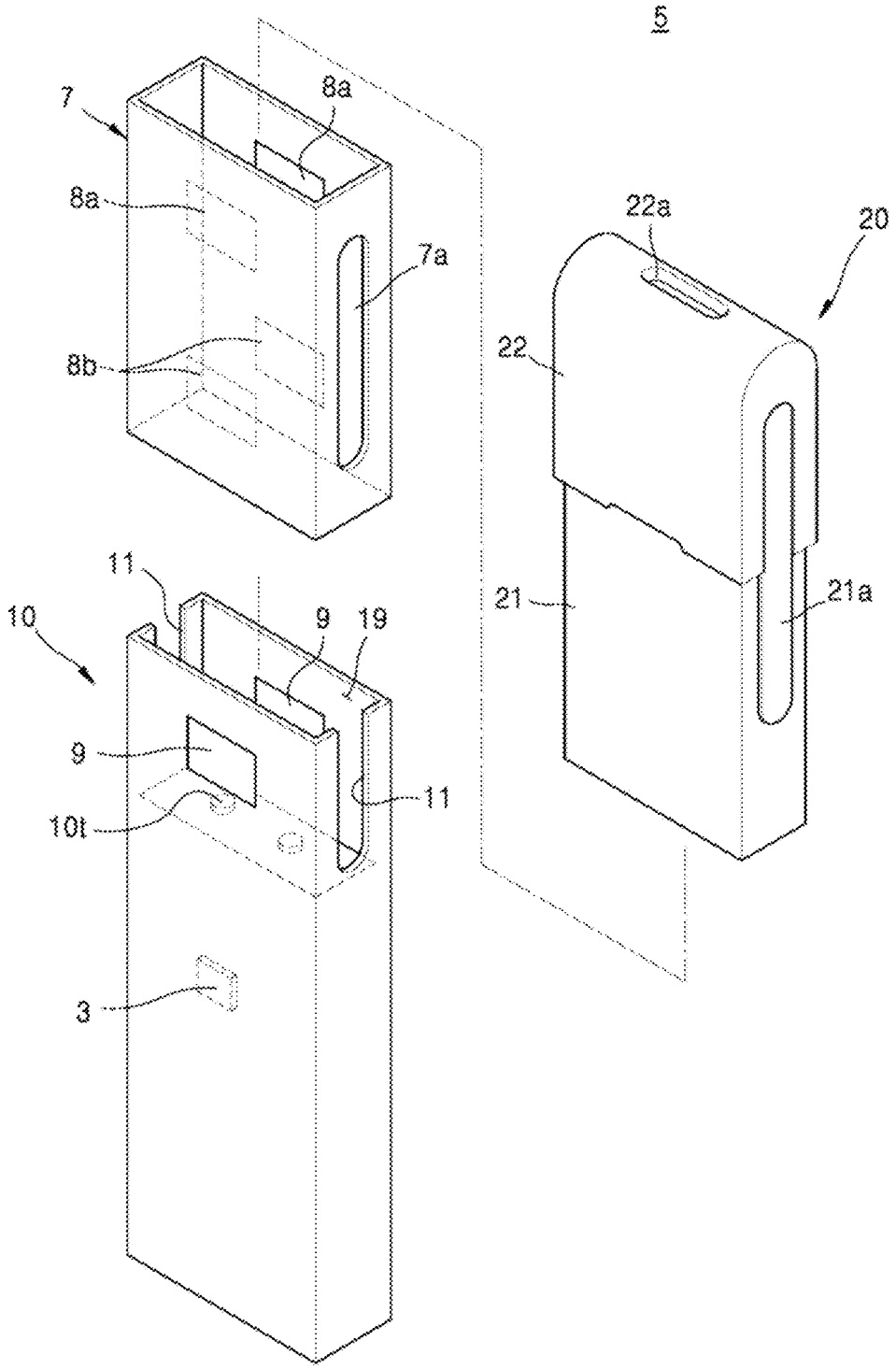

【Figure 2】
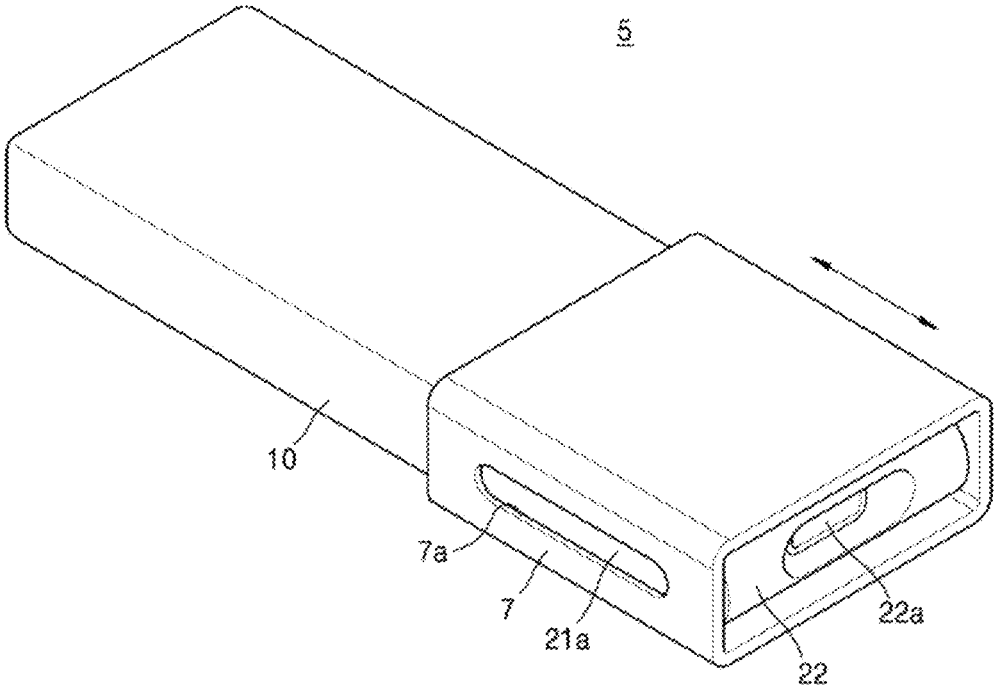
【Figure 3】
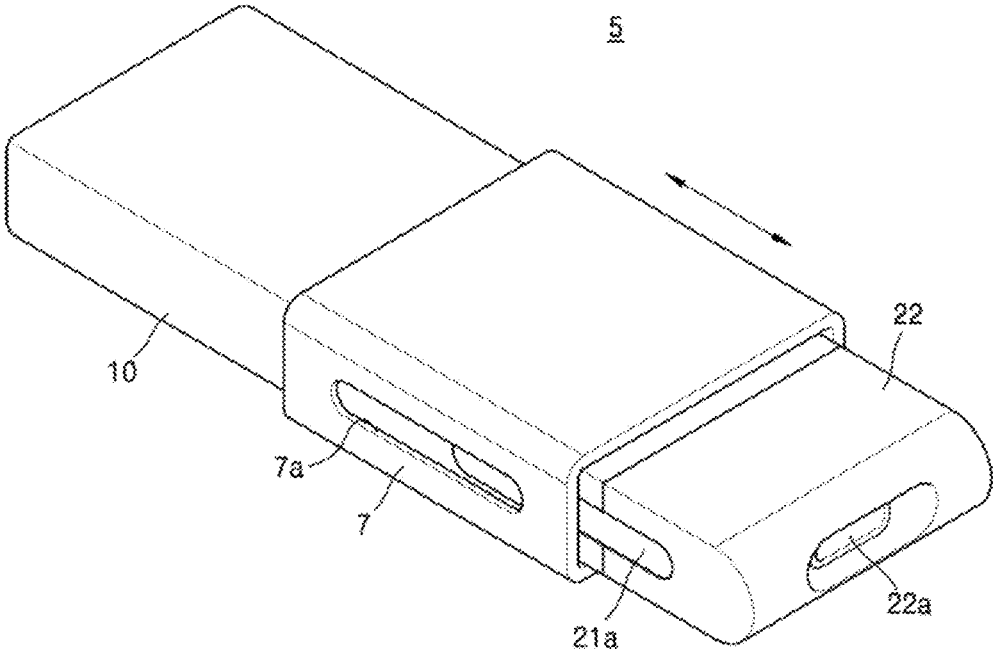

【Figure 4】
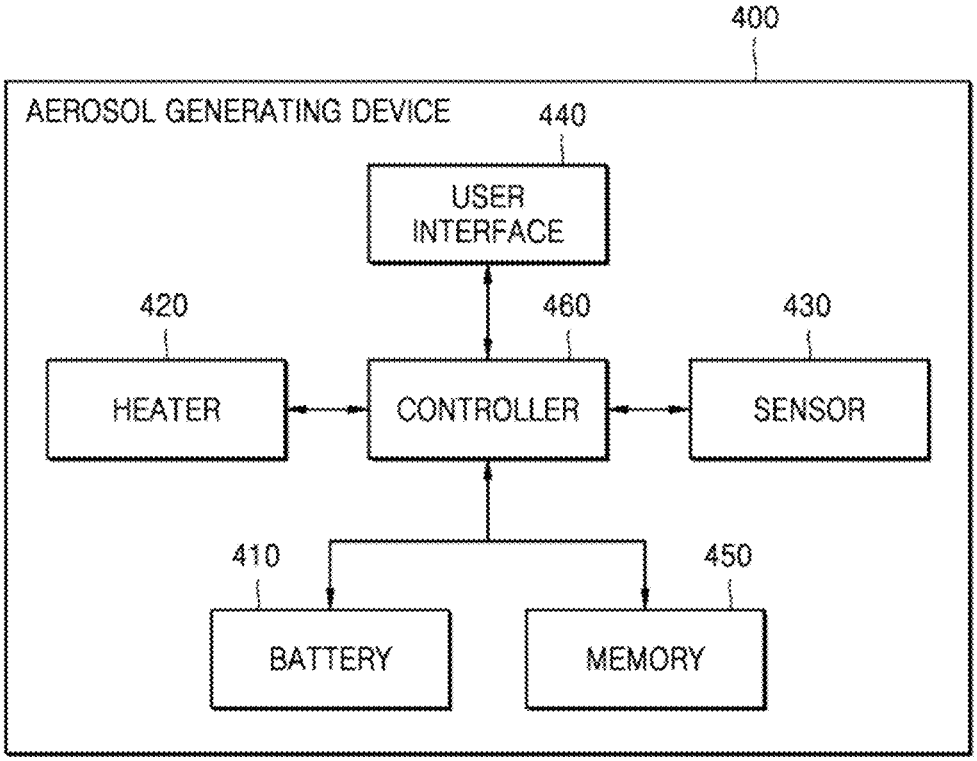

[Figure 5]
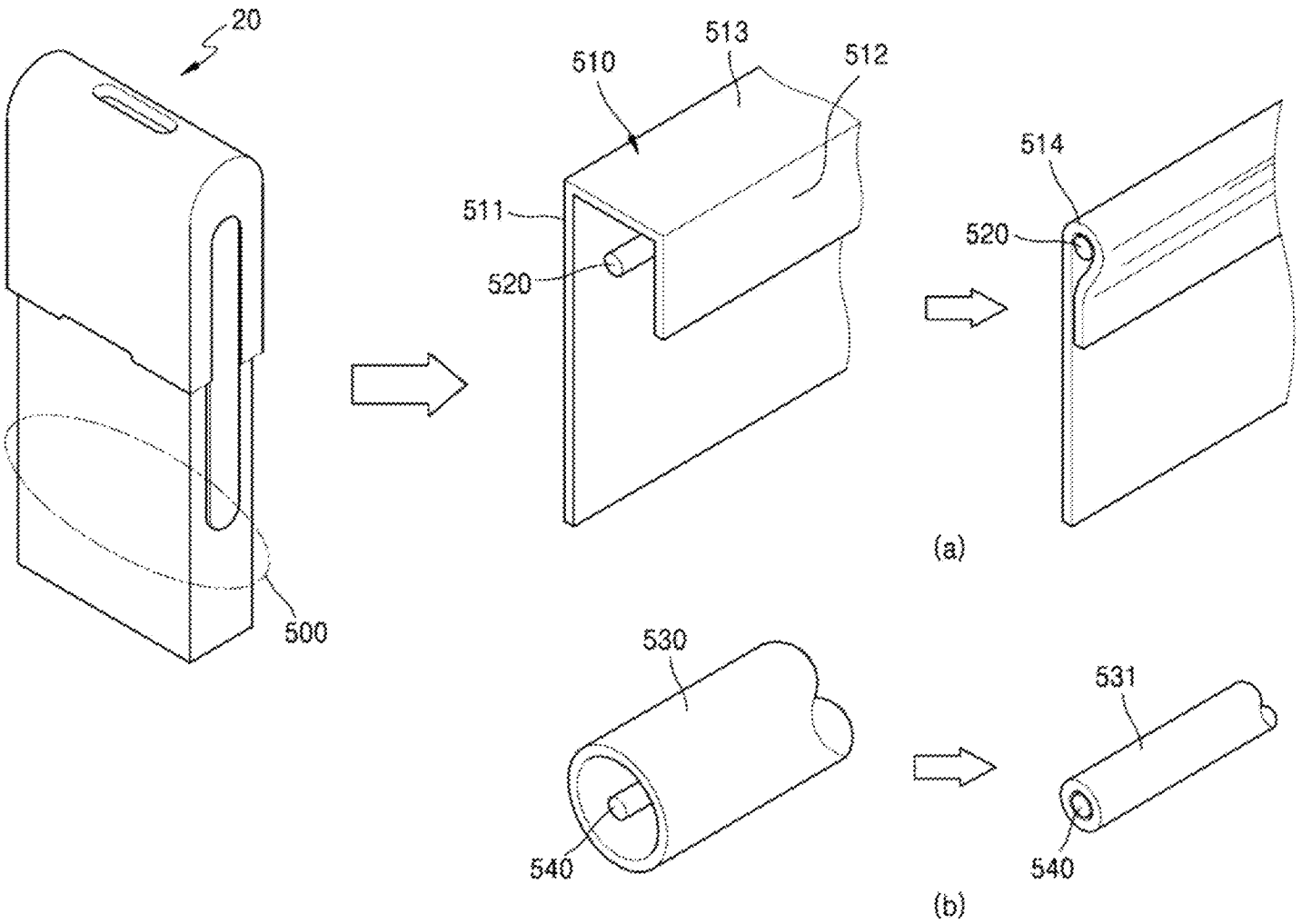

【Figure 6】
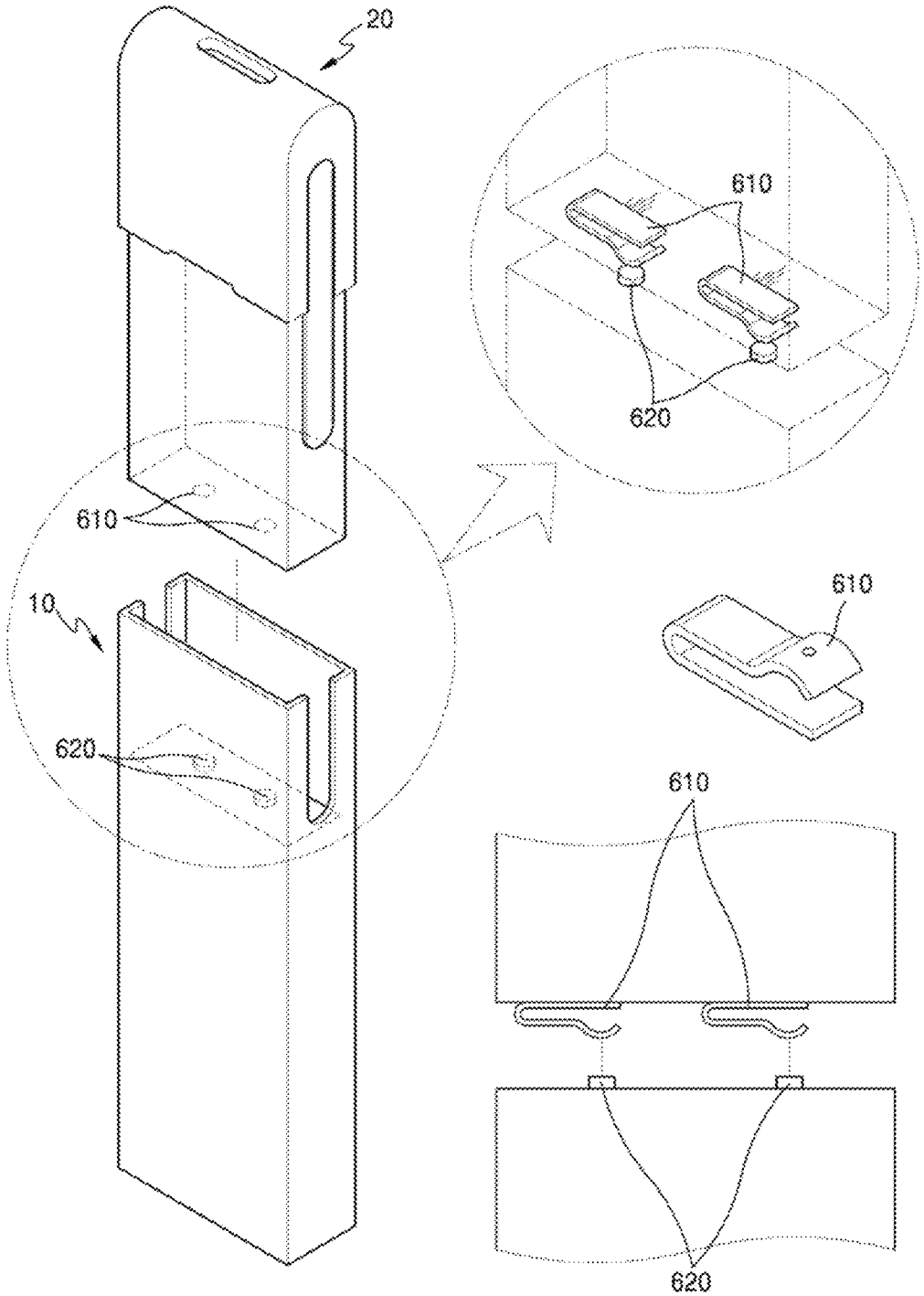

【Figure 7】
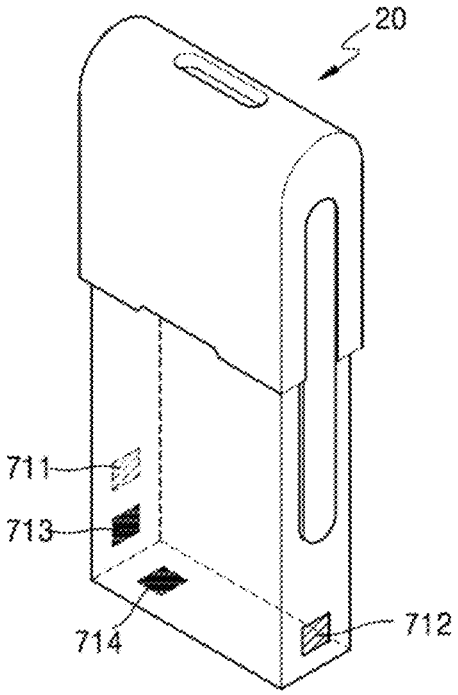

CARTRIDGE AND AEROSOL GENERATING DEVICE INCLUDING THE SAME

TECHNICAL FIELD

The present disclosure relates to a cartridge and an aerosol generating device including the same.

BACKGROUND ART

Recently, the demand for an alternative to traditional cigarettes has greatly increased. For example, there is growing demand for an aerosol generating device that generates aerosol by heating an aerosol generating material rather than by combusting cigarettes. Therefore, there has been active research into a heating-type aerosol generating device.

DISCLOSURE

Technical Problem

*3There is the need for an improved manufacturing process for a terminal of a cartridge that receive power from an external battery.

There is the need for a terminal of a cartridge that provides a stable electrical connection between the cartridge and an external battery that provides power to the cartridge.

Technical Solution

According to one or more embodiments, a cartridge includes a storage configured to store an aerosol generating material; a heater configured to heat the aerosol generating material to generate aerosol; and at least one terminal configured to transfer power from an external battery to the heater and comprising a conductive structure surrounding a wire connected to the heater, wherein the conductive structure is formed by compression such that the wire is in contact with the conductive structure.

The conductive structure before the compression may include a first side surface, a second side surface parallel with the first side surface and shorter than the first side surface, and a third side surface connecting the first side surface to the second side surface, and the conductive structure is formed by compressing the second side surface and the third side surface to close the open portion of the structure while the wire is disposed between the first side surface and the second side surface.

Alternatively, the conductive structure before the compression may include at least one pipe-shaped structure, and the conductive structure may be formed by compressing the at least one pipe-shaped structure to close the open portion while the wire is disposed in the pipe-shaped structure.

The at least one terminal may include a plurality of terminals having a same polarity and located in different sides among sides forming an outer shape of the cartridge.

The at least one terminal may have a curved shape.

According to one or more embodiments, an aerosol generating device includes a cartridge comprising a storage configured to store an aerosol generating material and a heater configured to heat the aerosol generating material to generate aerosol; and a main body electrically connected to the cartridge, wherein the cartridge comprises at least one terminal configured to transfer power from the main body to the heater and comprising a conductive structure surrounding a wire connected to the heater, and wherein the conductive structure takes a compressed form in which the wire is in contact with the conductive structure.

The conductive structure may be transformed from a structure including a first side surface, a second side surface that is in parallel with the first side surface and shorter than the first side surface, and a third side surface connecting the first side surface to the second side surface, and the conductive structure is formed by compressing the second side surface and the third side surface to close the open portion of the structure while the wire is disposed between the first side surface and the second side surface.

Alternatively, the conductive structure may be transformed from at least one pipe-shaped structure, and the conductive structure is formed by compressing the at least one pipe-shaped structure to close the open portion while the wire is disposed in the pipe-shaped structure.

The at least one terminal may include a plurality of terminals having a same polarity and located in different sides among sides forming an outer shape of the cartridge.

The main body may include a controller configured to generate a notification signal when the plurality of terminals are not electrically connected to terminals of the main body.

The at least one terminal may have a curved shape.

Advantageous Effects

As the structure is attached to the heater or the wire connected to the heater by pressing, compared with the case where it is attached by soldering, it is possible to obtain an improved effect in terms of the manufacturing process and numerical management of the cartridge. In addition, when the structure is a terminal, as the contact area between the terminal and the heater or the wire connected to the heater is increased, the efficiency of power transmission to the heater may be improved.

In addition, as at least a part of the structure is manufactured in a curved shape, the area where the structure contacts the other terminal is widened. Accordingly, the electrical connection between the cartridge and the body can be stably maintained.

In addition, as the cartridge includes a plurality of structures having the same polarity and disposed on different sides of the cartridge, the disconnection between the cartridge and the body due to leakage of the aerosol generating material may be prevented.

In addition, when each of the plurality of structures included in the cartridge is not electrically connected to the terminals included in the main body, a notification signal may be generated and output. Therefore, the user can easily recognize an error due to poor contact between the cartridge and the main body.

DESCRIPTION OF DRAWINGS

The above and other aspects, features, and advantages of certain embodiments of the disclosure will be more apparent from the following description taken in conjunction with the accompanying drawings, in which:

FIG. 1 is an exploded perspective view schematically illustrating a coupling relationship between a replaceable cartridge containing an aerosol generating material and an aerosol generating device including the same, according to an embodiment;

FIG. 2 is a perspective view of an exemplary operating state of the aerosol generating device according to the embodiment illustrated in FIG. 1;

FIG. 3 is a perspective view of another exemplary operating state of the aerosol generating device according to the embodiment illustrated in FIG. 1;

FIG. 4 is a block diagram illustrating hardware components of an aerosol generating device according to an embodiment;

FIG. 5 shows diagrams of examples of a structure according to an embodiment;

FIG. 6 is a diagram of an example of the shape of at least a portion of a structure, according to an embodiment; and FIG. 7 is a diagram of examples of structures formed in a cartridge, according to an embodiment.

BEST MODE

According to one or more embodiments, a cartridge includes a storage configured to store an aerosol generating material; a heater configured to heat the aerosol generating material to generate aerosol; and at least one terminal configured to transfer power from an external battery to the heater and comprising a conductive structure surrounding a wire connected to the heater, wherein the conductive structure is formed by compression such that the wire is in contact with the conductive structure.

Mode for Invention

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. There are terms discretionally selected by an applicant on particular occasions. These terms will be explained in detail in relevant description. Therefore, terms used herein are not just names but should be defined based on the meaning of the terms and the whole content of the present disclosure.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 may be inserted into an accommodation space 19 of the main body 10 so that the cartridge 20 may be coupled to the main body 10.

The cartridge 20 may contain an aerosol generating material in at least one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material, using, for example, an ultrasonic vibration method or an induction heating method. In an embodiment, the cartridge 20 may include its own power source and generate aerosol based on an electric control signal or a wireless signal received from the main body 10.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element containing an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

At least a portion of the liquid storage 21 of the cartridge 20 may include a transparent portion so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 in such a way that the slider 7 may move on the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* may be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

The slider 7, the slider 7 may be stably maintained in a position where an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and may generate a signal based on the detected change.

In the aerosol generating device 5 according to the above-described embodiments, horizontal cross sections of the main body 10, the cartridge 20, and the slider 7 have approximately rectangular shapes (i.e., when viewed in the longitudinal direction), but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly, and may be curved in a streamlined shape or bent at a preset angle in a specific area to be easily held by the user.

FIG. 2 is a perspective view of an exemplary operating state of the aerosol generating device according to the embodiment illustrated in FIG. 1.

In FIG. 2, the slider 7 is moved to a position where the end of the mouthpiece 22 of the cartridge coupled to the main body 10 is covered. In this state, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

FIG. 3 is a perspective view of another exemplary operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge is still exposed to the outside through the elongated hole 7*a* of the slider 7 when the slider 7 is moved to the position where the end of the mouthpiece 22 is exposed to the outside. Thus, the user may visually check the remaining amount of aerosol generating material contained in the cartridge, regardless of the position of the slider 7.

Referring to FIG. 1, the aerosol generating device 5 may include a position change detecting sensor 3. The position change detecting sensor 3 may detect a change in a position of the slider 7.

In one embodiment, the position change detection sensor 3 may detect a change in magnetization of magnetic material or a direction, intensity, or the like of a magnetic field. The slider 7 may include a magnet, and the position change detection sensor 3 may detect the movement of the magnet included in the slider 7.

For example, the position change detecting sensor 3 may include a Hall effect sensor, a rotating coil, a magnetoresistor, or a superconducting quantum interference device (SQUID) but is not limited thereto.

In the following description, the position of the slider 7 as shown in FIG. 2 where the slider 7 covers the end of the mouthpiece 22 is referred to as a first position. And, the position of the slider 7 as shown in FIG. 3 where the slider 7 exposes the end of the mouthpiece 22 to the outside is referred to as a second position. Since the slider 7 is slidably coupled to the main body 10, the user can move the slider 7 between the first position and the second position. The position change detection sensor 3 may detect the position change of the slider 7 moving between the first position and the second position.

In one embodiment, when the slider 7 is moved from the first position to the second position, the controller of the aerosol generating device 5 may receive an input signal from the position change detection sensor 3. The controller may set the mode of the aerosol generating device 5 to a preheating mode in response to the input signal.

In addition, the controller may determine whether the cartridge 20 is coupled to the main body 10. The aerosol generating device 5 may include a separate sensor for detecting whether the cartridge 20 and the main body 10 are coupled. Alternatively, the controller may determine whether the cartridge 20 is coupled to the main body 10 by periodically applying current to a circuit of the main body 10 that is electrically connected to a heater of the cartridge 20 and receiving an output value.

In one embodiment, after the cartridge 20 is coupled to the main body 10, the controller may set the mode of the aerosol generating device 5 to the preheating mode in response to the input signal received from the position change detection sensor 3. When it is determined that the cartridge 20 is not coupled to the main body 10, even if the controller receives an input signal from the position change detection sensor 3, the controller may not set the mode of the aerosol generating device 5 to the preheating mode.

In addition, the controller may set the mode of the aerosol generating device 5 to the sleep mode based on the position change of the slider 7. In one embodiment, when the slider 7 is moved from the second position to the first position, the controller receives the input signal from the position change detection sensor 3 and then sets the mode of the aerosol generating device 5 to the sleep mode.

FIG. 4 is a block diagram illustrating hardware components of the aerosol generating device according to an embodiment.

Referring to FIG. 4, the aerosol generating device 400 may include a battery 410, a heater 420, a sensor 430, a user interface 440, a memory 450 and a controller 460. However, the inner structure of the aerosol generating device 400 is not limited to what is illustrated in FIG. 4. One of ordinary skill in the art will understand that some hardware components illustrated in FIG. 4 may be omitted or new components may be added, according to the design of the aerosol generating device 400.

In an embodiment, the aerosol generating device 400 may include only a main body without a cartridge. In this case, the components of the aerosol generating device 400 may be located in the main body. In one or more embodiments, the aerosol generating device 400 may include a main body and a cartridge, and the components of the aerosol generating device 400 may be located in the main body and/or the cartridge.

Hereinafter, the operation of each of the hardware components of the aerosol generating device 400 will be described without limiting the location of each component.

The battery 410 supplies electric power to be used for the aerosol generating device 400 to operate. For example, the battery 410 may supply power such that the heater 420 may be heated. In addition, the battery 410 may supply power required for operation of other components of the aerosol generating device 400, such as the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 106. The heater 420 may receive power from the battery 410 and heat a cigarette inserted into the aerosol generating device 400 or a cartridge coupled to the aerosol generating device 400.

The heater 420 may be located in a main body of the aerosol generating device 400. Alternatively, the heater 420 may be located in the cartridge. When the heater 420 is located in the cartridge, the heater 420 may receive power from the battery 410, which is located the main body and/or the cartridge.

The heater 420 may include a suitable electrically resistive material For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. The heater 420 may include a metal plate including a metal wire or an electroconductive track or a ceramic heating element but is not limited thereto.

In an embodiment, the heater 420 may be included in the cartridge. The cartridge may include the heater 420, the liquid delivery element, and the liquid storage. The aerosol generating material accommodated in the liquid storage may be absorbed by the liquid delivery element, and the heater 420 may heat the aerosol generating material absorbed by the liquid delivery element, thereby generating aerosol. For example, the heater 420 may include a material such as nickel or chromium and may be wound around or arranged adjacent to the liquid delivery element.

Alternatively, the heater 420 may heat a cigarette inserted into an accommodation space of the aerosol generating device 400. when the cigarette is accommodated in the accommodation space of the aerosol generating device 400, the heater 420 may be located inside and/or outside the cigarette and heat an aerosol generating material of the cigarette to generate aerosol.

The heater 420 may include an induction heating heater. The heater 420 may include an electroconductive coil to heat a cigarette or a cartridge using an induction heating method, and the cigarette or the cartridge may include a susceptor which may be heated by an induction heating heater.

The aerosol generating device 400 may include at least one sensor 430. A sensing result of the at least one sensor 430 may be transmitted to the controller 460, and the controller 460 may control the aerosol generating device 400 to perform various functions, such as control of the operation of the heater 420, limitation of smoking, determination of insertion or non-insertion of a cigarette (or a cartridge), and display of notification, according to the sensing result.

For example, the at least one sensor 430 may include a puff detecting sensor. The puff detecting sensor may detect a user's puff based on a temperature change, a flow change, a voltage change, and/or a pressure change.

The at least one sensor 430 may include a temperature detecting sensor. The temperature detecting sensor may sense the temperature of the heater 420 (or aerosol generating material). The aerosol-generating device 400 may include a separate temperature detecting sensor for sensing the temperature of the heater 420, or the heater 420 itself may serve as a temperature detecting sensor. Alternatively, while the heater 420 functions as a temperature detecting sensor, a separate temperature detecting sensor may be further included in the aerosol generating device 400.

The sensor 430 may include a position change detecting sensor. The position change detecting sensor may detect a change in a position of the slider which slides along the main body.

The user interface 440 may provide a user with information about a state of the aerosol generating device 400. The user interface 440 may include various interfacing elements, such as a display or a lamp which outputs visual information, a motor outputting tactile information, a speaker outputting sound information, terminals which exchange data with input/output (I/O) interfacing elements (e.g., buttons or touch screens) receiving information input by a user or outputting information to a user or receive charging power, and a communication interfacing module which performs wireless communication (e.g., Wi-Fi, Wi-Fi Direct, Bluetooth, near-field communication (NFC)) with an external device.

However, only some of the given examples of the user interface 440 may be selectively implemented in the aerosol generating device 400.

The memory 450 may store data processed by the controller 460 and data to be processed. The memory 450 may include various types of memory such as dynamic RAM (DRAM), static RAM (SRAM), read-only memory (ROM), electrically erasable programmable ROM (EEPROM), etc.

The memory 450 may store data about an operating time of the aerosol generating device 400, a maximum puff count, a current puff count, at least one temperature profile, a user's smoking pattern, and the like.

The controller 460 may control overall operations of the aerosol generating device 400. The controller 460 includes at least one processor. A processor can be implemented as an array of a plurality of logic gates or can be implemented as a combination of a microprocessor and a memory in which a program executable in the microprocessor is stored. It will be understood by one of ordinary skill in the art that the processor may be implemented as another type of hardware.

The controller 460 analyzes the sensing result of the at least one sensor 460 and controls subsequent processes.

*94Based on the sensing result of the at least one sensor 430, the controller 460 may control power supplied to the heater 420 such that the operation of the heater 420 starts or ends. Based on the sensing result of the at least one sensor 430, the controller 460 may also control the amount of power supplied to the heater 420 and a power supply time such that the heater 420 may be heated to a certain temperature or maintained at a certain temperature.

In an embodiment, the aerosol generating device 400 may have a plurality of modes. For example, the modes of the aerosol generating device 400 may include a preheating mode, an operating mode, an idle mode, and a sleep mode. However, the modes of the aerosol generating device 400 are not limited thereto.

When the aerosol generating device 400 is not used, the aerosol generating device 400 may remain in the sleep mode. In the sleep mode, the controller 460 may control output power of the battery 410 such that power is not supplied to the heater 420. For example, before or after the use of the aerosol generating device 400, the aerosol generating device 400 may operate in the sleep mode.

To start the operation of the heater 420 after receiving a user input for the aerosol generating device 400, the controller 460 may set the mode of the aerosol generating device 400 to the preheating mode or may change the mode from the sleep mode to the preheating mode.

After detecting a user's puff using a puff detecting sensor, the controller 460 may change the mode of the aerosol generating device 400 from the preheating mode to a heating mode.

*99When an operating time of the aerosol generating device 400 in the heating mode exceeds a predefined time, the controller 460 may change the mode of the aerosol generating device 400 from the heating mode to the idle mode.

The controller 460 may count the number of puffs using a puff detecting sensor. When the number of puffs reaches a maximum puff count, the controller 460 may interrupt power supply to the heater 420.

A temperature profile may be set in accordance with each of the preheating mode, the operating mode, and the idle mode. The controller 460 may control power supplied to the heater 420 based on a power profile for each mode such that an aerosol generating material is heated according to a temperature profile for each mode.

The controller 460 may control the user interface 440 based on a sensing result of the sensor 430. For example, when the number of puffs counted using a puff detecting sensor reaches a predefined puff count, the controller 460 may notify a user that the aerosol generating device 400 will stop shortly, using a lamp, a motor, and/or a speaker.

In an embodiment, the predefined puff count may be less than the maximum puff count, at which the heater 420 stops, by a certain number. For example, in the case where the maximum puff count is set to 10, when the number of puffs counted by a puff detecting sensor reaches 9, the controller 460 may notify a user that the aerosol generating device 400 will stop shortly, using a lamp, a motor, and/or a speaker.

When the controller 460 counts puffs using a puff detecting sensor and the current puff count reaches the maximum puff count, the controller 460 may stop the operation of the heater 420. For example, when the current puff count reaches the maximum puff count, the controller 460 may set the mode of the aerosol generating device 400 to the sleep mode.

Although not shown in FIG. 4, the aerosol generating device 400 may form an aerosol generating system together with a separate cradle. For example, the cradle may be used to charge the battery 410 of the aerosol generating device 400. For example, in a state where the aerosol generating device 400 is accommodated in an accommodation space of the cradle, the aerosol generating device 400 may receive power from a battery of the cradle such that the battery 410 of the aerosol generating device 400 may be charged.

The heater 420 may be heated by power supplied from the battery 410. To this end, the heater 420 may be electrically connected to the battery 410. For example, the heater 420 may be electrically connected to the battery 410 directly or through a wire connected to the heater 420. Accordingly, when the heater 420 is accommodated in the cartridge 20, the cartridge 20 may include a structure which enables electrical connection between the heater 420 and the battery 410. To this end, the structure may be conductive.

In an embodiment, the structure may be compressed together with the heater 420 or a wire connected to the heater 420, without a process such as soldering. Accordingly, the structure may be in contact with the heater 420 or the wire connected to the heater 420. As a result, the heater 420 or the wire connected to the heater 420 may be in physical contact with the structure, and accordingly, the heater 420 may be electrically connected to the battery 410.

For example, the structure may be a terminal which creates electrical connection between two objects. In other words, when the structure is electrically connected to the heater 420 and contacts a terminal located in the main body 10, the heater 420 may be electrically connected to the battery 410. The structure may be a cover which protects the heater 420 and/or a wire connected to the heater 420.

When the structure is attached to the heater 420 or the wire connected to the heater 420 by compression, there may be improvement in manufacturing processes and numerical management compared to when the structure is coupled to the heater 420 or the wire connected to the heater 420 by soldering. When the structure is a terminal, efficiency of power transmission to the heater 420 may increase as a contact area between the terminal and the heater 420 or the wire connected to the heater 420 increases by the structure.

For example, the structure may be made of metal but is not limited thereto. The material of the structure may include any material that has conductivity.

Hereinafter, examples of the structure will be described with reference to FIGS. 5A and 5B.

FIGS. 5A and 5B are diagrams of examples of the structure according to an embodiment.

It is assumed that the heater 420 is located inside the cartridge 20 in the examples to be described with reference to FIGS. 5A and 5B. However, in another embodiment, the heater 420 may be located outside the cartridge 20 and physically separated from the cartridge 20. It is also assumed that a wire 520 or 540 connected to the heater 420 is accommodated in a structure 510 or 530. A portion of the heater 420 may also be accommodated in the structure 510 or 530, as described above with reference to FIG. 4.

At least a portion of the structure 510 or 530 may be open, and the structure 510 or 530 may accommodate at least a portion of the wire 520 or 540. During the manufacture process of the cartridge 20, external force may be applied to the structure 510 or 530. Accordingly, the structure 510 or 530 may be compressed, and the outer shape of the structure 510 or 530 may be transformed. As a result, the transformed structure 514 or 531 is in physical contact with the wire 520 or 540, and may be installed in the position 500 to be exposed to the outside of the cartridge 20. Accordingly, the cartridge 20 may be electrically connected to the battery 410 included in the main body 10 through the wire 520 or 540.

Referring to FIG. 5A, the structure 510 may include a first side surface 511, a second side surface 512, and a third side surface 513. The third side surface 513 may be arranged to connect the first side surface 511 to the second side surface 512, and the second side surface 512 may have a smaller area than the first side surface 511. The structure 510 may have an open portion between the first side surface 511 and the second side surface 512. The wire 520 may be located in an inner space formed by the first through third side surfaces 511, 512, and 513.

When external force is applied to the structure 510, the second side surface 512 and the third side surface 513 may be compressed. Accordingly, the open portion of the structure 510 is closed, and the wire 520 may physically contact and be attached to the compressed structure 514.

Referring to FIG. 5B, the structure 530 may have a pipe shape having a cavity exposed to the outside, and the wire 520 may be located in the cavity. When an external force is applied to the structure 530, the cavity of the structure 530 may be compressed, and the compressed structure 531 may have a closed cavity. Accordingly, the compressed structure 531 may physically contact and be attached to the wire 540.

In the case where the heater 420 is located inside the cartridge 20 and the battery 410 is located inside the main body 10, when the cartridge 20 is connected to the main body 10, power of the battery 410 is supplied to the heater 420. At this time, a terminal for electrical connection may be provided in each of the cartridge 20 and the main body 10.

The structure 510 or 530 may serve as a terminal, and at least a portion of the structure 510 or 530 may have a curved shape. For example, the entirety or a portion of the structure 510 or 530 may have a C-clip shape as shown in FIG. 6.

Compared to the wire 520 alone, a contact area of the structure 510 or 530 is much larger. As such, the electrical connection between the cartridge 20 and the main body 10 may be stably maintained.

Hereinafter, an example of the shape of at least a portion of the structure 510 or 530 will be described with reference to FIG. 6.

FIG. 6 is a diagram of an example of the shape of at least a portion of a structure, according to an embodiment.

FIG. 6 shows a structure 610 located in the cartridge 20 and a terminal 620 located in the main body 10. As described above with reference to FIGS. 5A and 5B, the structure 610 may function as a terminal.

At least a portion of the structure 610 may have a curved shape. In particular, a portion of the structure 610 contacting an electrode may have a curved shape having an open side. For example, a portion of the structure 610 contacting an electrode may have a C-clip shape. As such, the electrical connection between the cartridge 20 and the main body 10 may be stably maintained.

In general, two terminals respectively corresponding to both electrodes, i.e., an anode and a cathode, may be provided in an electronic device. However, according to an embodiment, the cartridge 20 may include a plurality of structures having the same polarity. The plurality of structures having the same polarity may be respectively located in different sides among the sides forming the outer shape of the cartridge 20.

When an aerosol generating material leaks out of the liquid storage 21, leaked liquid may stagnate in a lower portion of the cartridge 20. In this case, when a pair of terminals are located in the lower portion of the cartridge 20, the terminals may contact the stagnant liquid and thus be electrically disconnected.

According to an embodiment where a plurality of structures of the same polarity are respectively located in different sides of the cartridge 20, if an aerosol generating material leaks out of the liquid storage 21, at least a pair of structures (i.e., a structure corresponding to an anode and a structure corresponding to a cathode) for maintaining the electrical connection may be kept away from the leaked liquid. Accordingly, electrical disconnection between the cartridge 20 and the main body 10 may be prevented.

When structures of the cartridge 20 are not electrically connected to terminals of the main body 10, the controller 460 may generate a notification signal. The notification signal is output through the user interface 440. For example, the notification signal may correspond to visual information, sound information, or tactile information. Accordingly, a user may easily recognize an error caused by poor contact between the cartridge 20 and the main body 10.

Hereinafter, examples of structures located in a cartridge will be described with reference to FIG. 7.

FIG. 7 is a diagram of examples of structures formed in a cartridge, according to an embodiment.

FIG. 7 shows structures 711, 712, 713, and 714 located in the cartridge 20. For example, the structures 711 and 712 may function as terminals corresponding to an anode and the structures 713 and 714 may function as terminals corresponding to a cathode. The embodiment shown in FIG. 7 is just an example, and the number and position of the structures are not limited thereto.

The structures 711 and 712 are respectively located in different sides of the cartridge 20. Similarly, the structures 713 and 714 are respectively located in different sides of the cartridge 20.

The structure 711 may be paired with the structure 713 or 714. The structure 712 may be paired with the structure 713 or 714. According to the cartridge 20 of FIG. 7, if any one of such four pairs normally contacts electrodes of the main body 10, the cartridge 20 may be electrically connected to the main body 10.

When a structure is attached to a heater or a wire connected to the heater by compression, there may be improvement in manufacturing processes and numerical management compared to when the structure is coupled to the heater or the wire connected to the heater by soldering. When the structure is a terminal, efficiency of power transmission to the heater may increase as a contact area between the terminal and the heater or the wire connected to the heater increases by the structure.

When at least a portion of the structure has a curved shape (e.g., a C-clip shape), the electrical connection between the cartridge and a main body may be stably maintained.

When the cartridge includes a plurality of structures of the same polarity which are located in different sides of the cartridge, electrical disconnection between the cartridge and the main body due to leakage of an aerosol generating material may be prevented.

When structures of the cartridge are not electrically connected to terminals of the main body, a notification signal may be generated and output. Accordingly, a user may easily recognize an error caused by poor contact between the cartridge and the main body.

At least one of the components, elements, modules or units (collectively "components" in this paragraph) represented by a block in the drawings such as the controller 460, the user interface 440, and the sensor 430 may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

The invention claimed is:

1. A cartridge comprising:

a storage configured to store an aerosol generating material;

a heater configured to heat the aerosol generating material to generate aerosol; and at least one terminal configured to transfer power from an external battery to the heater and comprising a conductive structure surrounding a wire connected to the heater, wherein the conductive structure takes a compressed form in which the wire is in contact with the conductive structure.

2. The cartridge of claim 1, wherein the conductive structure is transformed from a structure including a first side surface, a second side surface that is in parallel with the first side surface and has a smaller area than the first side surface, and a third side surface connecting the first side surface to the second side surface, and the conductive structure is formed by compressing the second side surface and the third side surface to close an opening between the first side surface and the second side surface while the wire is disposed between the first side surface and the second side surface.

3. The cartridge of claim 1, wherein the conductive structure is transformed from at least one pipe-shaped structure, and the conductive structure is formed by compressing the at least one pipe-shaped structure to close an opening of the pipe-shaped structure while the wire is disposed in the pipe-shaped structure.

4. The cartridge of claim 1, wherein the at least one terminal comprises a plurality of terminals having a same polarity and located in different sides among sides forming an outer shape of the cartridge.

5. The cartridge of claim 1, wherein the at least one terminal has a curved shape.

6. An aerosol generating device comprising:

a cartridge comprising a storage configured to store an aerosol generating material and a heater configured to heat the aerosol generating material to generate aerosol; and a main body electrically connected to the cartridge, wherein the cartridge comprises at least one terminal configured to transfer power from the main body to the heater and comprising a conductive structure surrounding a wire connected to the heater, and wherein the conductive structure takes a compressed form in which the wire is in contact with the conductive structure.

7. The aerosol generating device of claim 6, wherein the conductive structure is transformed from a structure including a first side surface, a second side surface that is parallel with the first side surface and has a smaller area than the first side surface, and a third side surface connecting the first side surface to the second side surface, and the conductive structure is formed by compressing the second side surface and the third side surface to close an opening between the first side surface and the second side surface while the wire is disposed between the first side surface and the second side surface.

8. The aerosol generating device of claim 6, wherein the conductive structure is transformed from at least one pipe-shaped structure, and the conductive structure is formed by compressing the at least one pipe-shaped structure to close an opening of the pipe-shaped structure while the wire is disposed in the pipe-shaped structure.

9. The aerosol generating device of claim 6, wherein the at least one terminal has a curved shape.

10. The aerosol generating device of claim 6, wherein the at least one terminal comprises a plurality of terminals having a same polarity and located in different sides among sides forming an outer shape of the cartridge.

11. The aerosol generating device of claim 10, wherein the main body includes a controller configured to generate a notification signal when the plurality of terminals are not electrically connected to terminals of the main body.

* * * * *